United States Patent [19]

Inoue

[11] 4,269,672

[45] May 26, 1981

[54] GAP DISTANCE CONTROL ELECTROPLATING

[75] Inventor: Kiyoshi Inoue, Tokyo, Japan

[73] Assignee: Inoue-Japax Research Incorporated, Tokyo, Japan

[21] Appl. No.: 154,953

[22] Filed: May 30, 1980

[30] Foreign Application Priority Data

Jun. 1, 1979 [JP] Japan ..... 54-67483

[51] Int. Cl.[3] ..... C25D 5/04; C25D 7/04

[52] U.S. Cl. ..... 204/23; 204/25

[58] Field of Search ..... 204/23, 25, 26, 14 R

[56] References Cited

U.S. PATENT DOCUMENTS

| | | | |
|---|---|---|---|
| 1,733,404 | 10/1929 | Fahrenwald | 204/26 |
| 1,772,074 | 8/1930 | Engelhardt | 204/26 |
| 2,206,908 | 7/1940 | Lunt | 204/23 |

*Primary Examiner*—T. M. Tufariello

*Attorney, Agent, or Firm*—Karl F. Ross

[57] ABSTRACT

An improved method of electroplating a metal upon a substrate wherein a rod electrode is axially juxtaposed with the substrate across an electrolyte-flooded plating gap and electrodeposition occurs preferentially in the region of the substrate proximal to an end portion of the rod electrode. The rod electrode is displaced relative to the substrate while its axis is kept oriented substantially perpendicular to a fixed plane to allow the metal to be successively and continuously electrodeposited over the entire area of the substrate to be electroplated. The improved method comprises controlling the position of the rod electrode relative to the surface contour of the substrate while maintaining the relationship $G=Gs/\sin\alpha$ substantially over the area where Gs is a distance defined between the electrode end and the point of intersection of the extension of the electrode axis and the surface contour, $\alpha$ is an angle defined by said extension with a tangent of the surface contour at said point of intersection and G is a constant representing a reference gap spacing.

7 Claims, 6 Drawing Figures

GAP DISTANCE CONTROL ELECTROPLATING

FIELD OF THE INVENTION

The present invention relates to an electroplating and, more particularly, to an improved method of uniformly electroplating a metal upon a curved, irregular or generally non-planar surface, i.e. of a workpiece substrate to be coated thereby or of a mold from which the plated layer is subsequently removed to yield an electroformed product.

BACKGROUND OF THE INVENTION

In metal electroplating upon a non-planar substrate, it has generally been recognized to be advantageous to employ a simple elongate or rod-like electrode which is slender and straight and may generally be continuous in composition over its length (hereinafter "rod electrode" or "electrode rod"). The rod electrode is energized in an electroplating system in which it is poled as anodic relative to a workpiece of a larger area poled cathodic and is, in the presence of a plating electrolyte, juxtaposed with the latter to provide an active plating electrode face at its end portion to allow electrodeposition of a metal from the electrolyte upon the region of the workpiece or substrate surface proximal to the active electrode face. In the process, the rod electrode is displaced in a scanning manner along the surface of the substrate to successively and continuously electrodeposit the metal over the entire area of the substrate.

In practicing the electrode scanning operation, it is conceivable to control both the position and attitude of the rod electrode such that its axis is oriented always perpendicular to the tangent to the substrate surface at any point and its end portion constituting the active anode face is always spaced with a fixed distance from the substrate surface at any point while the residence time of the electrode active face relative to each point on the surface is kept to be uniform. In this case the greater the interelectrode distance, the greater is the loss in consumed electric power and the more irregular becomes the plated layer in thickness. On the other hand, the reduction of the distance forced the electrode to move along an increased path of scanning, entailing a greater length of displacement program. An excessive undulation in scanning may also ensue. It is therefore desirable that a proper selection be made for the dimension of the interelectrode distance to be maintained during the scanning operation in accordance with the particular configuration and area of the substrate to be electroplated. To allow the attitude control of the rod electrode from one position to another, however, necessitates a complicated and costly arrangement and also entails complicated calculations in the preparation of a suitable scanning operation program, and cannot therefore be practical.

Accordingly, in the procedure followed heretofore, the rod electrode is retained with its axis always oriented parallel with a given axis (z-axis) or perpendicular to a given plane (x-y plane) and is displaced so that its active end moves along an imaginary curvature defined by the parallel shift, along the same axis, of the surface contour of the substrate by a distance of interest. In this procedure, the latter distance or the distance measured from the electrode end along the extension of the electrode axis to the point of its intersection with the surface contour or the substrate is held to be constant. This procedure allows preparation of a necessary scanning path program with ease and poses no material problem where the substrate contains no portion of acute inclination on its surface with respect to the extension of the electrode axis. When, however, such portion exists, the minimum distance between the active electrode face and the substrate is substantially reduced there, tending to cause an arc discharge or short-circuiting which is detrimental. Furthermore, electrodeposition tends to build up excessively and the active electrode face may erode irregularly in such areas. As a consequence, the operation becomes unsatisfactory both with respect to performance and plating precision.

OBJECT OF THE INVENTION

It is an important object of the invention to provide an improved electroplating method suitable for uniformly electrodepositing a metal on a curved, irregular and generally non-planar substrate which may be large in plating area.

Another important object of the invention is to provide an electroplating method which allows a non-planar substrate to be unformly electrodeposited with a relatively simplified operation to produce a high-quality and high-precision electroplated layer.

SUMMARY OF THE INVENTION

In accordance with the present invention, there is provided a method of electroplating a metal upon a substrate wherein a rod electrode is axially and spacedly juxtaposed with the substrate across an electrolyte flooded plating gap; and electric current is passed between the rod electrode and the substrate across the gap to electrodeposit a metal from the electrolyte at least preferentially on the region of the substrate proximal to the juxtaposed end portion of the rod electrode; and the rod electrode is displaced relative to the substrate while maintaining the orientation of its axis to be always substantially perpendicular to a fixed plane to successively electrodeposit the metal over the entire area of the substrate to be plated, the method comprising: controlling the position of the rod electrode relative to the surface contour of the substrate so that the following relationship is substantially maintained:

$$G = Gs/\sin\alpha$$

where G is a distance defined between the end of the rod electrode provimal to the substrate and the point of intersection of the extension of the axis of the rod electrode and the surface contour of the substrate, $\alpha$ is an angle defined by said extension with a tangent of the surface contour at said point of intersection and Gs is a constant representing a reference gap length.

BRIEF DESCRIPTION OF THE DRAWINGS

These and other objects and features of the invention as well as advantages thereof will become more readily apparent from the following description wherein.

SPECIFIC DESCRIPTION

Figure 1:
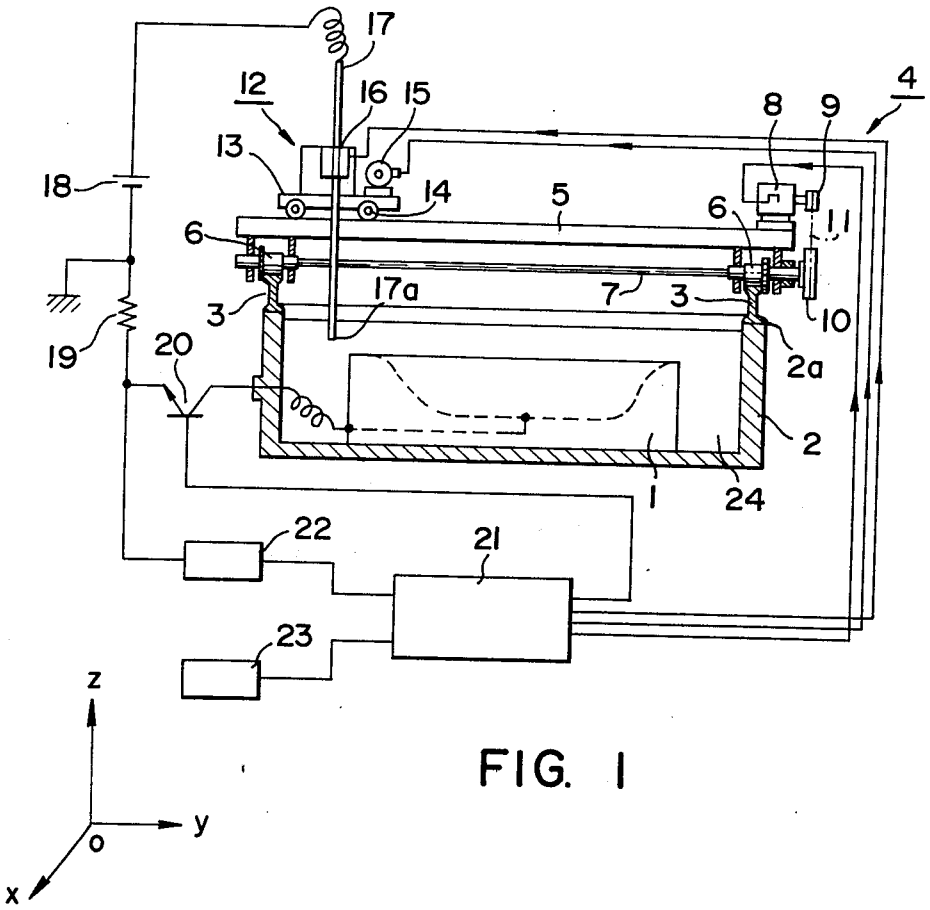
FIG. 1 is a diagrammatic view, partly in section, illustrating an exemplary electroplating system for embodying the method according to the present invention.

The electroplating system shown by way of example in FIG. 1 for explanation of the invention can be used to electroplate a metal upon a large, non-planar substrate constituted by a workpiece or mold (hereinafter "workpiece") shown at 1. The system shown comprises a plating tank or receptacle 2 formed on its top portion with parallel tracks 3 on which is guided an X-axis electrode carriage assembly 4. The X-axis electrode guide assembly 4 includes a carriage 5, a pair of wheels 6 in engagement with the tracks 3, a shaft 7, a stepping motor 8, sprocket wheels 9 and 10 and a chain 11. A Y-axis electrode carriage assembly 12 includes a carriage 13, a pair of wheels 14 which roll on the track of the X-axis carriage 5 and support the carriage 13 and a Y-axis stepping motor 15. A rod electrode 17 is carried as vertically displaceable on a support 16 secured on the Y-axis carriage 13 by means of a Z-axis stepping motor (not shown) provided therein. A direct-current electroplating power supply 18 is connected to the rod electrode 17 and the workpiece 1 via a resistor 19 and an on/off switch 20 to pole the electrode 17 anodic and the workpiece 1 cathodic. The resistor may be used as a portion of a sensing network 22 for integrating the plating current to indicate wear of the rod electrode 17. The switch 20, shown by a transistor, may be controlledly turned on and off by a signal pulser to apply the plating current in the form of a series of pulses between the rod electrode 17 and the workpiece 1 or to controlledly apply the plating current. A control unit 21 is energized by a clock timer 23 to furnish the X-axis stepping motor 8, the Y-axis stepping 15 and the Z-axis stepping motor with respective drive pulses generated in accordance with a predetermined drive program for the rod electrode 17 and also to furnish the control switch 20 with signal pulses.

Figure 2:
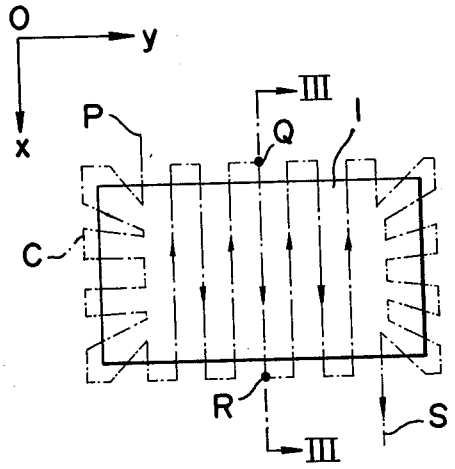
FIG. 2 is a plan view illustrating an exemplary path of movement of the rod electrode relative to a workpiece or mold.
Figure 3:
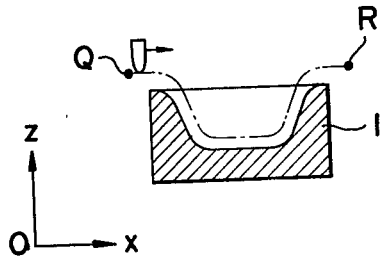
FIG. 3 is a sectional view of the workpiece or mold, taken along the line III—III, showing a portion of the movement path.

The rod electrode 17 is held by the support 16 or Z-axis carriage assembly to be oriented with its axis always perpendicular to a fixed X-Y plane and, as the assemblies 4, 12 and 16 are actuated by the respective stepping motors driven by the NC (numerical) portion of control unit 21, is displaced incrementally along three coordinates or axes X, Y and Z to allow its end 17*a* to follow a predetermined path, say, along a dot-dash line C shown in FIGS. 2 and 3, relative to the workpiece 1. As the relative displacement between the rod electrode 17 and the workpiece 1 proceeds, the rod electrode 17 allows the region of the workpiece 1 proximal to its active and 17*a* to preferentially receive electrodeposition, thus successively electrodepositing over the entire area of the workpiece 1 to be electroplated.

Figure 4:
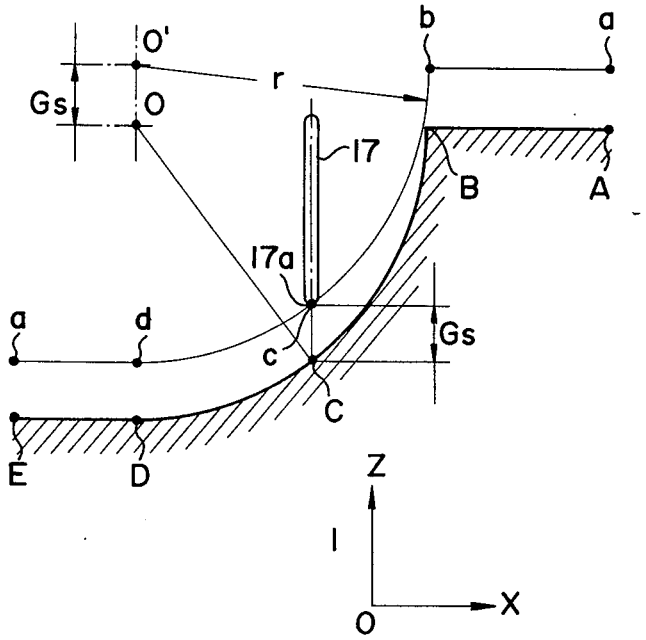
FIG. 4 is a sectional diagram illustrating the conventional method of controlling the position of the rod electrode relative to the substrate in a scanning displacement operation.

FIG. 4 illustrates the method used in the prior art for controlling the position of the rod electrode 17 relative to the workpiece 1 in executing such scanning operation. In this FIGURE, a surface contour of the workpiece 1 cut in a Z-X plane and a path of the end 17*a* of the rod electrode 17 juxtaposed therewith are shown. Here, the surface contour comprises a straight zone AB, an arc zone with a radius r and a planar zone DE at bottom. In such method, the path of the electrode end 17*a* shown by abcde represents a parallel shift, along the Z-axis, of the platable surface contour ABCDE by a fixed distance Gs. This method allows preparation of a necessary NC drive program with ease and poses no material problem when the workpiece contains no portion of acute inclination on its surface contour with respect to the extension of the axis of the electrode 17. When, however, such portion as a zone BC exists where the contour makes an acute inclination relative to the electrode axis, the minimum distance between the electrode end 17 a and the workpiece 1 is substantially reduced, tending to cause an arc discharge or short-circuiting which is detrimental. Furthermore, electrodeposition tends to concentrate and the active electrode end 17*a* may erode irregularly in such areas. As a result, the operation becomes unsatisfactory both as to performance and plating accuracy.

Figure 5:
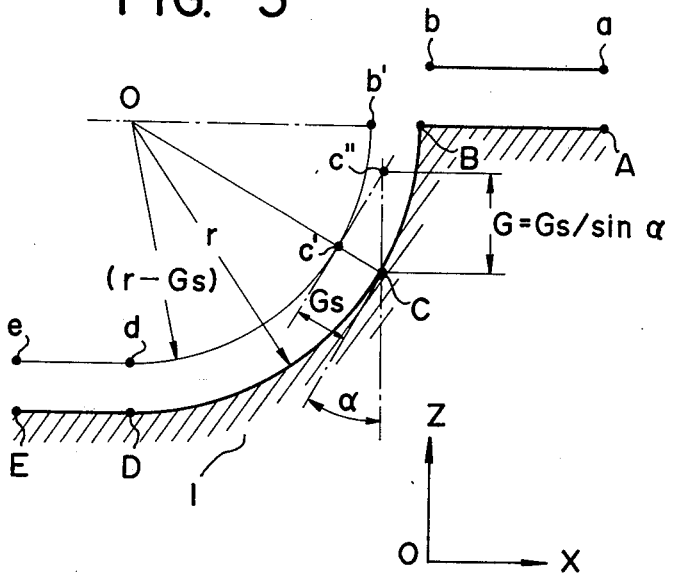
FIG. 5 is a sectional diagram illustrating a certain other conceivable manner of controlling the relative positions of the rod electrode and the substrate.

To solve such problem it is conceivable to employ, in lieu of the path section bcd, a path section b'c'd' shown in FIG. 5 which is parallel-shifted from the contour BCD in the direction of its radius by a length Gs while using identical portions ab and de for the remainder of the path shown. This requires the electrode end 17*a* after initial plating displacement from point a to point b to be repositioned from point b to point b' while the plating current is cut off and then, upon restoration of the plating current, to move along b'c'd'. While this method allows the system to be effectively protected against short-circuiting or arcing as aforementioned at the region of point B, it not only necessitates very complicated calculation and preparation procedures for a necessary drive program but is incapable of yielding a uniformity of electroplating as desirable. Given a fixed rate of displacement of the electrode 17 along the X-axis, it will be apparent that the time of residence of the electrode end 17*a* or effective plating period in the region of section BC become extremely shortened and thus the plating thickness there becomes only extremely thin. In an attempt to solve this problem the rate of displacement of the electrode 17 over the section b'c' may be reduced but this merely causes an excessive deposition of metal in the region of point B and eventually does not lead to a uniformity of electroplating.

In accordance with the present invention there is provided an improved method of controlling the position of the rod electrode relative to the workpiece in an electroplating system whereby NC programming can be performed with extreme ease and yet highly uniform and satisfactory plating results are obtained without the possibility of arcing or short-circuiting. Thus, the method according to the invention includes: controlling the position of the rod electrode relative to the workpiece so that the distance defined between the end 17*a* of the electrode 17 and the point of intersection of the extension of the axis thereof with the surface contour of the workpiece is maintained to satisfy the following relationship: $G=Gs/\sin\alpha$ where Gs is a constant reference distance and $\alpha$ is an angle defined by said extension with the tangential of the surface contour at said point of intersection.

In the prior-art method described in connection with FIG. 4, when the end 17*a* of electrode 17 is positioned and oriented directly or normally above any point C on the surface contour of the workpiece 1, the distance Gs between this point C and the electrode end 17*a* was a fixed value to be controlled. Further in a method described in connection with FIG. 5 the electrode 17 is simply parallel-shifted in the direction of the radius of any point C on the surface contour by a distance Gs which is again controlledly fixed. In contrast to these methods the method according to the invention concerns the distance G which, with the electrode 17 oriented directly above any point C on the surface contour of a workpiece, is defined between this point C and the electrode 17*a* such that the relationship: $G=Gs/\sin\alpha$ is substantially always satisfied. In this case, the position c″ occupied by the electrode end 17*a* represents the point of intersection of the axis of the electrode 17 with a plane which is parallel with the tangential plane at point C with respect to the surface contour and spaced by a distance Gs. This means that when the surface contour to be electroplated is planar, the minimum distance between the electrode end 17*a* and the surface coutour is constant Gs, regardless of the angle of inclination of the surface contour to be electroplated. It is also noted that when the surface contour is concaved as shown in FIGS. 4 and 5 the minimum distance between the electrode end 17*a* and the surface contour is always not greater than the reference distance Gs. When the platable surface contour is convexed, the minimum distance becomes not less than such reference distance Gs. In general, electrodeposition tends to build up thicker on a convex region than on a concave region. In the present method such tendency is effectively compensated for with the change in the interelectrode distance G along the extension of the electrode axis which increases or decreases correspondingly with change in convexity or concavity of the surface contour to be electroplated.

Figure 6:
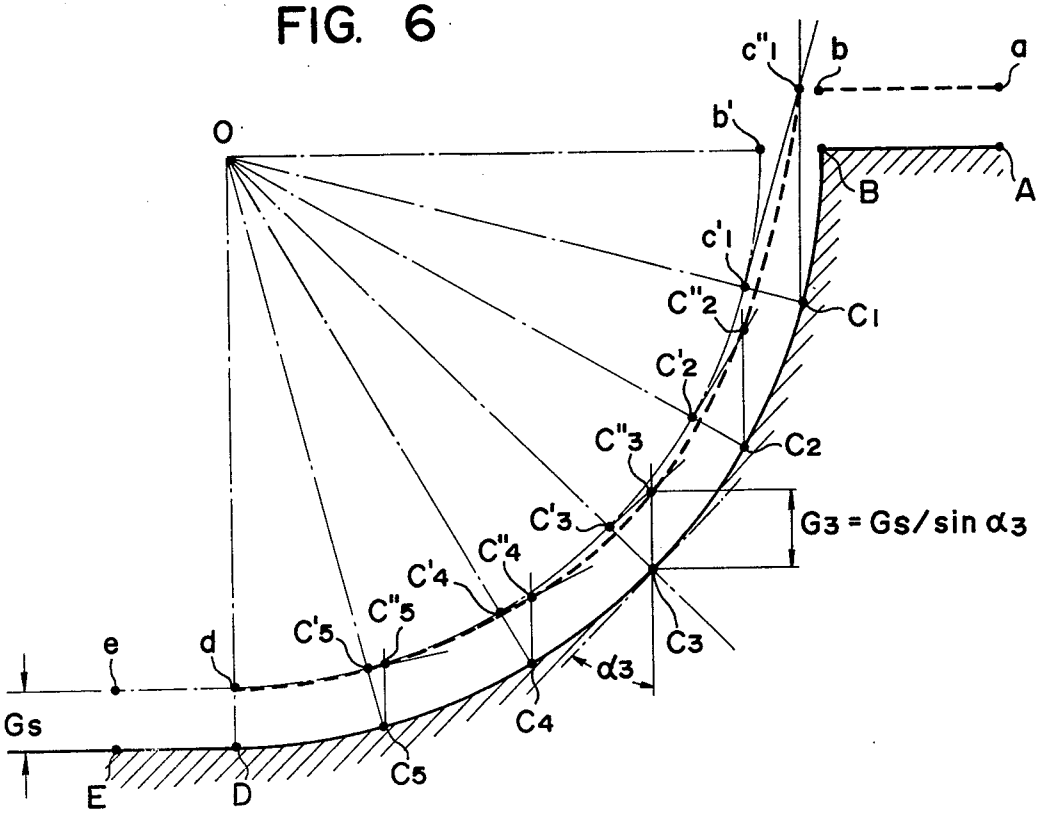
FIG. 6 is a sectional diagram illustrating the method of controlling the position of the rod electrode relative to the substrate in a scanning displacement operation according to the present invention.

A further description of the present invention is made with reference to FIG. 6. in this FIGURE, the plated surface ABC1C2C3C4C5DE is shown including a section C′1C′2C′3C4C5 which is an arc with a radius r. The curve b′c1′c2′c3′c4′c5′ is an arc with a radius (r-Gs). The path to be followed by the electrode end 17*a* according to the invention is obtained by smoothly connecting the points c1″, c2″, c3″, c4″ and c5″ which are located above the points C1, C2, C3, C4 and C5 and spaced from the latter points by distances Gs/sin $\alpha$1, Gs/sin $\alpha$2, Gs/sin $\alpha$3, Gs/sin $\alpha$4 and Gs/sin $\alpha$5, respectively. The sin of each angle $\alpha$1, $\alpha$2, $\alpha$3, $\alpha$4 and $\alpha$5 can readily be obtained from a drawing of the workpiece 1. The position of point C1 is selected such that the corresponding point c1″ on the path is located on the extension of line ab.

The section AB is electroplated while the electrode is displaced from point a to point b where $\alpha=90°$. When the electrode passes the point b, the angle becomes $\alpha=0$, indicating $G=Gs/\sin\alpha\rightarrow\infty$. For the section b1c1″, however, it is simply sufficient to cut off the plating current. Thus, commencing at point b1 the plating current is cut off until the point c1″ is reached in a straight-line path whereupon the plating current is restored to allow the electrode to follow the curved path c1″c2″c3″c4″c5″. In this manner, a necessary and sufficient electrode residence time is given for satisfactorily electrodepositing on the section BC1 as well. Yet, for such sections, the minimum distance between the electrode end 17*a* and the surface of the workpiece 1 which is reduced than the reference distance Gs and hence allows passage of an increased current is assured to such an extent that no arcing or short-circuiting may occur. Over the entire area of the workpiece 1, thus, highly uniform electrodeposition is achieved.

To enhance the uniformity in thickness of electrodeposition, the rate of displacement of the electrode may be controlled. If this is done, only a slight variation is sufficient and this can be done without causing an abnormal buildup of metal deposition on such regions as point B as mentioned before in connection with the method for comparison.

The reference distance Gs can be adjusted at a small value, say, 0.5 mm and generally between 0.1 and 10 mm and the rate of flow of the plating electrolyte in the region of the gap is preferably in the range between 5 and 20 meters/second. The plating current is preferably in the form of pulses of a duration, preferably less than 100 microseconds or less than 50 microseconds. The rod electrode is preferably composed of a metal, alloy or other substance such as carbon which is resistant to electrolytic dissolution. These settings allow passage of the plating current at a current density of 5 to 15 amperes/cm$^2$ which allows the plating rate to be 200 to 500 times greater than those obtainable with the low-current density method commonly practiced using a current density of 1 to 5 amperes/dm$^2$. The pulse plating, especially with a succession of narrow pulses indicated above assures stability of electrodeposition.

There is thus provided an improved method of electroplating a metal on a curved, irregular or non-planar substrate, which needs only simple NC programming and yet is capable of achieving electroplating with extreme ease on workpices of large areas or of diverse configurations.

What is claimed is:

1. A method of electroplating a metal upon a substrate wherein a rod electrode is axially and spacedly justaposed with the substrate across an electrolyte flooded plating gap; an electric current is passed between the rod electrode and the substrate across said gap to electrodeposit the metal from the electrolyte at least preferentially in the region of the substrate proximal to an end portion of said electrode justaposed therewith; and said rod electrode is displaced relative to said substrate while maintaining the orientation of its axis to be substantially perpendicular to a fixed plane to successively electrodeposit the metal over the entire area of said substrate to be electroplated, the method comprising the step of controlling the position of said rod electrode relative to the surface contour of said substrate in such a manner that the following relationship is maintained substantially over said area:

$$G=Gs/\sin\alpha$$

where G is a distance defined between the end of said rod electrode proximal to said substrate and the point of intersection of the extension of the axis of said electrode and said surface contour, $\alpha$ is an angle defined by said extension with a tangent of the surface contour at said point of intersection and Gs is a constant representing a reference gap spacing between said electrode and said workpiece.

2. The method defined in claim 1 wherein said plating electrolyte is passed in the region of said gap at a rate of flow in the range of 5 and 20 meters/second.

3. The method defined in claim 1 wherein said electric current is in the form of a succession of pulses of a duration not greater than 100 microseconds.

4. The method defined in claim 3 wherein said duration is at most 50 microseconds.

5. The method defined in claim 1 wherein said electric current is passed through said gap at a current density in the range between 5 and 15 amperes/$cm^2$.

6. The method defined in claim 1 wherein said reference distance Gs is at a value in the range between 0.1 and 10 mm.

7. The method defined in claim 1 wherein said rod electrode is displaced relative to said substrate incrementally along three mutually orthogonal coordinate axes.

* * * * *